US007941071B2

(12) United States Patent
Fujimori

(10) Patent No.: US 7,941,071 B2
(45) Date of Patent: May 10, 2011

(54) LUBRICANT APPLICATION DEVICE, PROCESS CARTRIDGE, AND IMAGE FORMING APPARATUS USING THE LUBRICANT APPLICATION DEVICE

(75) Inventor: Akira Fujimori, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 669 days.

(21) Appl. No.: 12/019,317

(22) Filed: Jan. 24, 2008

(65) Prior Publication Data

US 2008/0181689 A1 Jul. 31, 2008

(30) Foreign Application Priority Data

Jan. 29, 2007 (JP) ..... 2007-018224

(51) Int. Cl.
*G03G 15/08* (2006.01)

(52) U.S. Cl. ..... 399/102; 399/123; 399/346

(58) Field of Classification Search ..... 399/102, 399/123, 346

See application file for complete search history.

(56) References Cited

U.S. PATENT DOCUMENTS

| | | | | |
|---|---|---|---|---|
| 7,302,205 | B2 | 11/2007 | Shintani et al. | |
| 7,313,347 | B2 | 12/2007 | Shintani et al. | |
| 2004/0223780 | A1 * | 11/2004 | Thompson et al. | 399/102 |
| 2007/0258743 | A1 | 11/2007 | Shakuto et al. | |

FOREIGN PATENT DOCUMENTS

| | | | |
|---|---|---|---|
| JP | 3-18884 | | 1/1991 |
| JP | 2001-305907 | | 11/2001 |
| JP | 2002-244485 | | 8/2002 |
| JP | 2005-18047 | | 1/2005 |
| JP | 2005-242301 | | 9/2005 |
| JP | 2006-163318 | | 6/2006 |
| JP | 2006163318 A | * | 6/2006 |

* cited by examiner

*Primary Examiner* — David M Gray

*Assistant Examiner* — Laura K Roth

(74) *Attorney, Agent, or Firm* — Oblon, Spivak, McClelland, Maier & Neustadt, L.L.P.

(57) ABSTRACT

A lubricant application device includes a lubricant, a lubricant supplier, a lubricant smoother, and a sealing member. The lubricant is supplied to a surface of an image carrier for carrying a toner image. The lubricant supplier is provided downstream from a cleaning blade for removing residual toner after the toner image is transferred from the image carrier in a direction of movement of the image carrier and supplies the lubricant onto the surface of the image carrier. The lubricant smoother is provided downstream from the lubricant supplier in the direction of movement of the image carrier and slidably contacts the image carrier to smooth the supplied lubricant. The sealing member seals a space between the cleaning blade and the lubricant smoother at both ends of the lubricant supplier in an axial direction of the image carrier.

8 Claims, 6 Drawing Sheets

LUBRICANT APPLICATION DEVICE, PROCESS CARTRIDGE, AND IMAGE FORMING APPARATUS USING THE LUBRICANT APPLICATION DEVICE

CROSS-REFERENCE TO RELATED APPLICATION

The present application is based on and claims priority from Japanese Patent Application No. 2007-018224, filed on Jan. 29, 2007 in the Japan Patent Office, the entire contents of which are hereby incorporated herein by reference.

BACKGROUND OF THE INVENTION

1. Field of the Invention

Exemplary aspects of the present invention relate to a lubricant application device, a process cartridge, and an image forming apparatus using the lubricant application device, and more particularly, to a lubricant application device, a process cartridge, and an image forming apparatus using the lubricant application device for preventing a foreign substance from scattering and for efficiently applying a lubricant.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data by electrophotography. For example, a charger charges a surface of an image carrier. An optical writer emits a light beam onto the charged surface of the image carrier to form an electrostatic latent image on the image carrier according to the image data. A developing device develops the electrostatic latent image with a developer (e.g., toner) to form a toner image on the image carrier. The toner image is transferred from the image carrier onto a sheet via an intermediate transfer belt. A fixing device applies heat and pressure to the sheet bearing the toner image to fix the toner image on the sheet. Thus, the toner image is formed on the sheet.

After the toner image is transferred from the image carrier, a cleaning blade cleans the surface of the image carrier. For example, the cleaning blade slidably contacts the surface of the rotating image carrier to remove a foreign substance including residual toner remaining on the surface of the image carrier. As the cleaning blade continues slidably contacting the surface of the image carrier, the cleaning blade and the image carrier wear over time, thereby losing effectiveness. Moreover, when spherical toner particles having a small particle diameter are used in order to form a high quality image, the toner particles may invade a minute space between the image carrier and the cleaning blade and cause the cleaning blade to slip, resulting in insufficient cleaning of the surface of the image carrier.

In order to address this problem, one example of a related-art image forming apparatus includes a lubricant application device for applying a lubricant to the image carrier. Application of the lubricant to the surface of the image carrier may decrease a friction coefficient of the surface of the image carrier, thereby preventing wear of the cleaning blade and the image carrier so that lifetimes thereof may be extended. Further, the decrease in friction coefficient of the surface of the image carrier may prevent deformation of an edge of the cleaning blade and generation of a space between the image carrier and the cleaning blade, thereby preventing degradation in cleaning performance of the cleaning blade.

Another example of the related-art image forming apparatus includes a lubricant application device further including a lubricant smoother. The lubricant smoother smoothes a lubricant applied to the image carrier to form a lubricant layer of uniform thickness. Therefore, generation of a faulty image including a white spot, an image blur, and an insufficient image transfer may be prevented, and a function of a lubricant supplier (e.g., a rotating brush) to apply the lubricant to the image carrier may be maintained for a long time period.

However, a foreign substance including residual toner removed by the cleaning blade and a powder of the lubricant scraped by the rotating brush may scatter and adhere to functional components of the image forming apparatus, thereby causing generation of a faulty image. Further, when the foreign substance scatters in an axial direction of the image carrier, the foreign substance may adhere to components near the image carrier. Accordingly, when a user removes the image carrier from the image forming apparatus for maintenance or inspection, the foreign substance adhering to the components near the image carrier may adhere to the user, causing the user discomfort.

BRIEF SUMMARY OF THE INVENTION

This specification describes a lubricant application device according to exemplary embodiments of the present invention. In one exemplary embodiment of the present invention, the lubricant application device includes a lubricant, a lubricant supplier, a lubricant smoother, and a sealing member. The lubricant is supplied to a surface of an image carrier for carrying a toner image. The lubricant supplier is provided downstream from a cleaning blade for removing residual toner after the toner image is transferred from the image carrier in a direction of movement of the image carrier and configured to supply the lubricant to the surface of the image carrier. The lubricant smoother is provided downstream from the lubricant supplier in the direction of movement of the image carrier and configured to slidably contact the image carrier to smooth the lubricant supplied to the surface of the image carrier. The sealing member is configured to seal a space between the cleaning blade and the lubricant smoother at both ends of the lubricant supplier in an axial direction of the image carrier. The cleaning blade and the lubricant smoother are configured to seal a space between the surface of the image carrier and the cleaning blade and a space between the surface of the image carrier and the lubricant smoother in a circumferential direction perpendicular to the axial direction of the image carrier.

This specification further describes a process cartridge according to exemplary embodiments of the present invention. In one exemplary embodiment of the present invention, the process cartridge is attachable to and detachable from an image forming apparatus, and includes an image carrier, a cleaning blade, and a lubricant application device. The image carrier is configured to carry a toner image. The cleaning blade is configured to remove residual toner after the toner image is transferred from the image carrier. The lubricant application device includes a lubricant, a lubricant supplier, a lubricant smoother, and a sealing member as described above.

This specification further describes an image forming apparatus according to exemplary embodiments of the present invention. In one exemplary embodiment of the present invention, the image forming apparatus includes an image carrier, a cleaning blade, and a lubricant application device. The image carrier is configured to carry a toner image. The cleaning blade is configured to remove residual toner after the toner image is transferred from the image carrier. The lubricant application device includes a lubricant, a lubricant supplier, a lubricant smoother, and a sealing member, again as described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
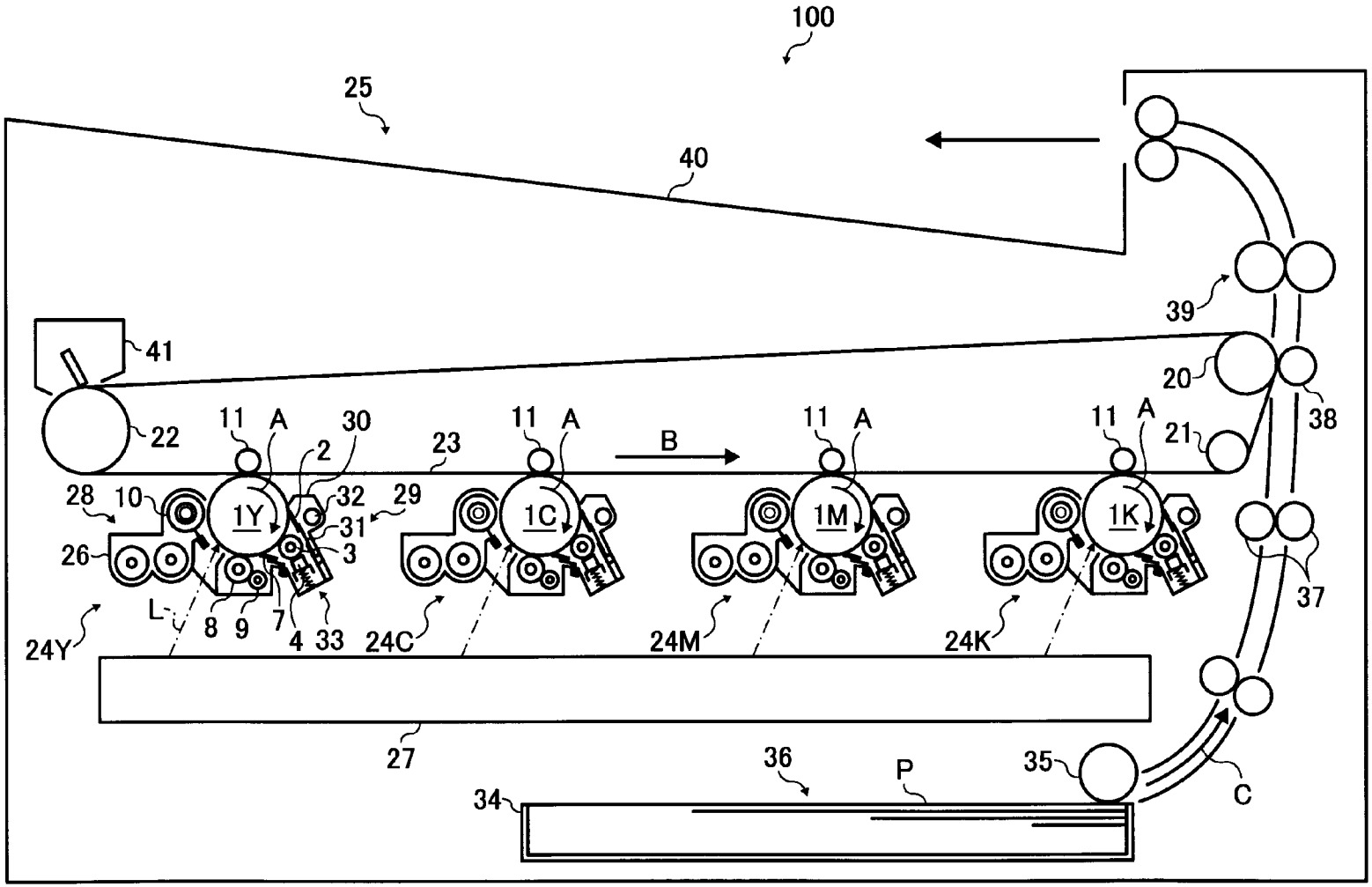
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

The image forming apparatus 100 includes a body 25 and an output tray 40. The body 25 includes process cartridges 24Y, 24C, 24M, and 24K, an intermediate transfer belt 23, support rollers 20, 21 and 22, transfer rollers 11, a feeding device 36, a registration roller pair 37, a second transfer roller 38, a fixing device 39, a cleaner 41, and an optical writer 27. The process cartridges 24Y, 24C, 24M, and 24K respectively include photoconductors 1Y, 1C, 1M, and 1K, unit cases 26, development devices 28, charging rollers 8, cleaning rollers 9, cleaners 29, and lubricant application devices 33. The feeding device 36 includes a paper tray 34 and a feeding roller 35. The development device 28 includes a development roller 10. The cleaner 29 includes a cleaning case 30, a cleaning blade 2, a blade holder 31, and a toner conveyance screw 32. The lubricant application device 33 includes a rotating brush 3, a solid lubricant 4, and a lubricant applicator blade 7.

The endless intermediate transfer belt 23 is looped over the support rollers 20, 21 and 22, and driven to rotate in a direction B. The process cartridges 24Y, 24C, 24M, and 24K oppose the first transfer rollers 11 via the intermediate transfer belt 23, and form yellow, cyan, magenta, and black toner images, respectively. The photoconductors 1Y, 1C, 1M, and 1K have a drum-like shape and serve as an image carrier for carrying the toner images in the respective colors. The toner images are transferred and superimposed onto the intermediate transfer belt 23. The intermediate transfer belt 23 is one example of a transfer member to which the toner images formed on the photoconductors 1Y, 1C, 1M, and 1K are transferred.

The following describes a structure in which the yellow toner image is formed on the photoconductor 1Y of the process cartridge 24Y and transferred onto the intermediate transfer belt 23. The process cartridges 24C, 24M, and 24K have a structure equivalent to that of the process cartridge 24Y, and therefore redundant descriptions thereof are omitted hereinafter.

The photoconductor 1Y of the process cartridge 24Y is held by the unit case 26 and driven to rotate clockwise (e.g., a direction of rotation A) by a driving device (not shown). The unit case 26 also holds the charging roller 8, the cleaning roller 9 for cleaning the charging roller 8, and the development roller 10. When the photoconductor 1Y is driven to rotate, a charging voltage is applied to the charging roller 8, thereby charging a surface of the photoconductor 1Y with a predetermined polarity. The optical writer 27 is separated from the process cartridge 24Y and emits an optically modulated laser beam L to the charged photoconductor 1Y, so as to form an electrostatic latent image on the photoconductor 1Y. The development device 28 visualizes the electrostatic latent image formed on the photoconductor 1Y as a yellow toner image.

By application of a transfer voltage to the first transfer roller 11, the yellow toner image is transferred onto the intermediate transfer belt 23 rotating in the direction B. After transfer of the toner image, the cleaner 29 removes residual toner adhered to the photoconductor 1Y. The cleaning case 30 forms a part of the unit case 26. The cleaning blade 2 includes a top edge contacting the surface of the photoconductor 1Y. The blade holder 31 holds the cleaning blade 2. The toner conveyance screw 32 is provided in the cleaning case 30 and driven to rotate. The cleaning blade 2 is provided in a direction counter to the direction of rotation A of the photoconductor 1Y. The cleaning blade 2 includes an elastic body such as a rubber. A base edge of the cleaning blade 2 is fixed to the blade holder 31 with an adhesive, for example. The residual toner on the photoconductor 1Y is scraped and removed by the top edge of the cleaning blade 2 contacting the surface of the photoconductor 1Y. The removed toner is carried outside the cleaning case 30 by the rotating toner conveyance screw 32. Thus, the cleaning blade 2 cleans the photoconductor 1Y after the toner image is transferred to the transfer member (e.g., the intermediate transfer belt 23).

The lubricant application device 33 applies the solid lubricant 4 to the photoconductor 1Y. The lubricant applicator blade 7, serving as a lubricant smoother, smoothes the solid lubricant 4 applied to the photoconductor 1Y.

Similarly, the cyan, magenta, and black toner images are formed on the photoconductors 1C, 1M, and 1K, respectively, and transferred and superimposed in this order onto the intermediate transfer belt 23 carrying the yellow toner image, so as to form a color toner image on the intermediate transfer belt 23. As is the case with the photoconductor 1Y, the cleaners 29 remove residual toners on the photoconductors 1C, 1M, and 1K after transfer of the toner images, respectively.

The feeding device 36 is provided in a lower portion of the body 25. The paper tray 34 stores a recording medium P including a transfer sheet, for example. Rotation of the feeding roller 35 causes an uppermost recording medium P to be fed in a direction C. The second transfer roller 38 opposes the support roller 20 via the intermediate transfer belt 23. The fed recording medium P is conveyed to a nip formed between the intermediate transfer belt 23 looped over the support roller 20 and the second transfer roller 38 by the registration roller pair 37 at a proper time. A predetermined transfer voltage is applied to the second transfer roller 38 to transfer the color toner image formed on the intermediate transfer belt 23 onto the recording medium P.

The recording medium P bearing the color toner image is conveyed further upward and passes through the fixing device 39, where the toner image on the recording medium P is fixed by an effect of heat and pressure. After passing through the fixing device 39, the recording medium P is discharged to the output tray 40 provided on top of the body 25. The cleaner 41 removes residual toner adhered on the intermediate transfer belt 23 after transfer of the toner image.

Figure 2:
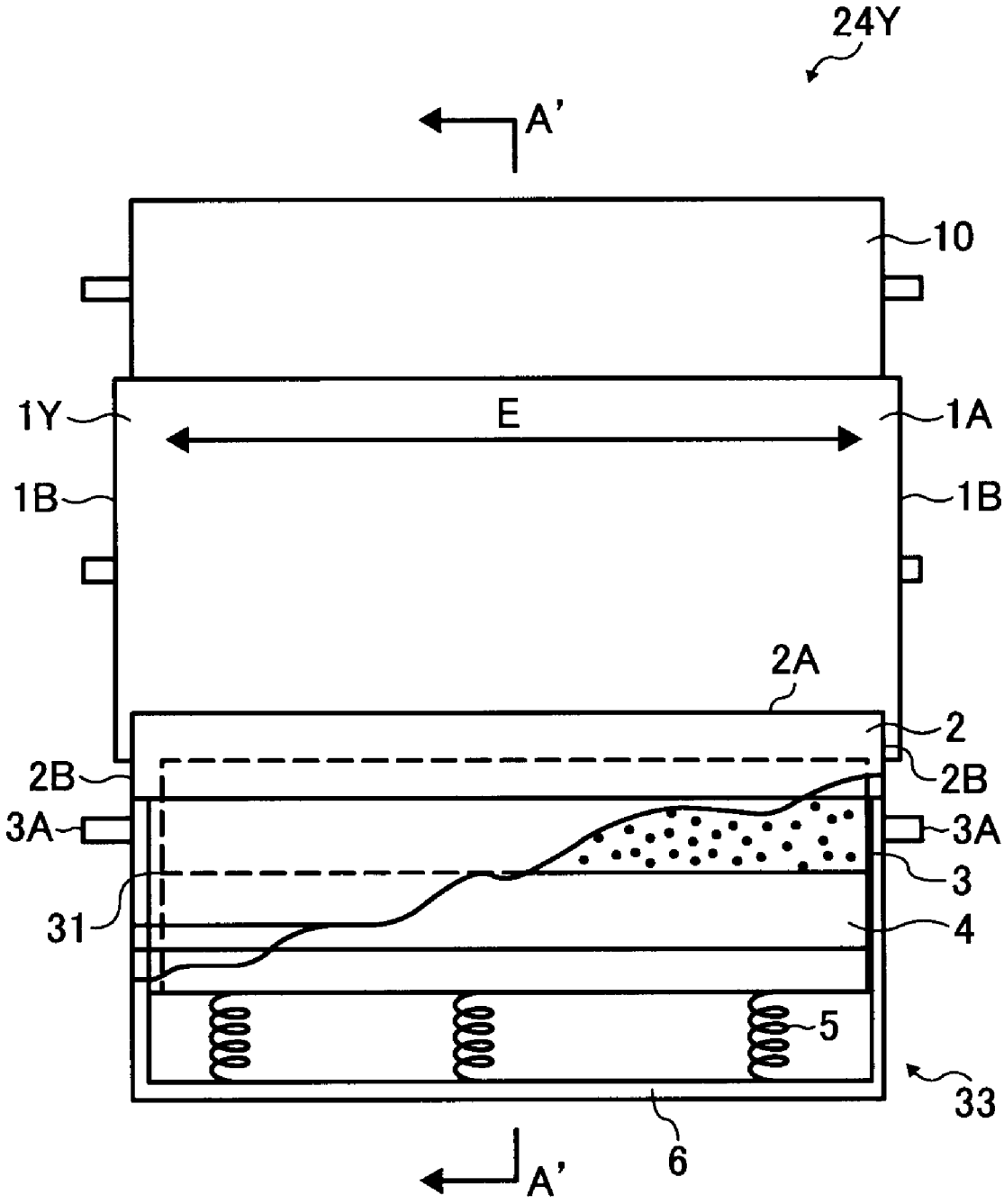
FIG. 2 is a partial cutaway top view of a process cartridge included in the image forming apparatus shown in FIG. 1.
Figure 3:
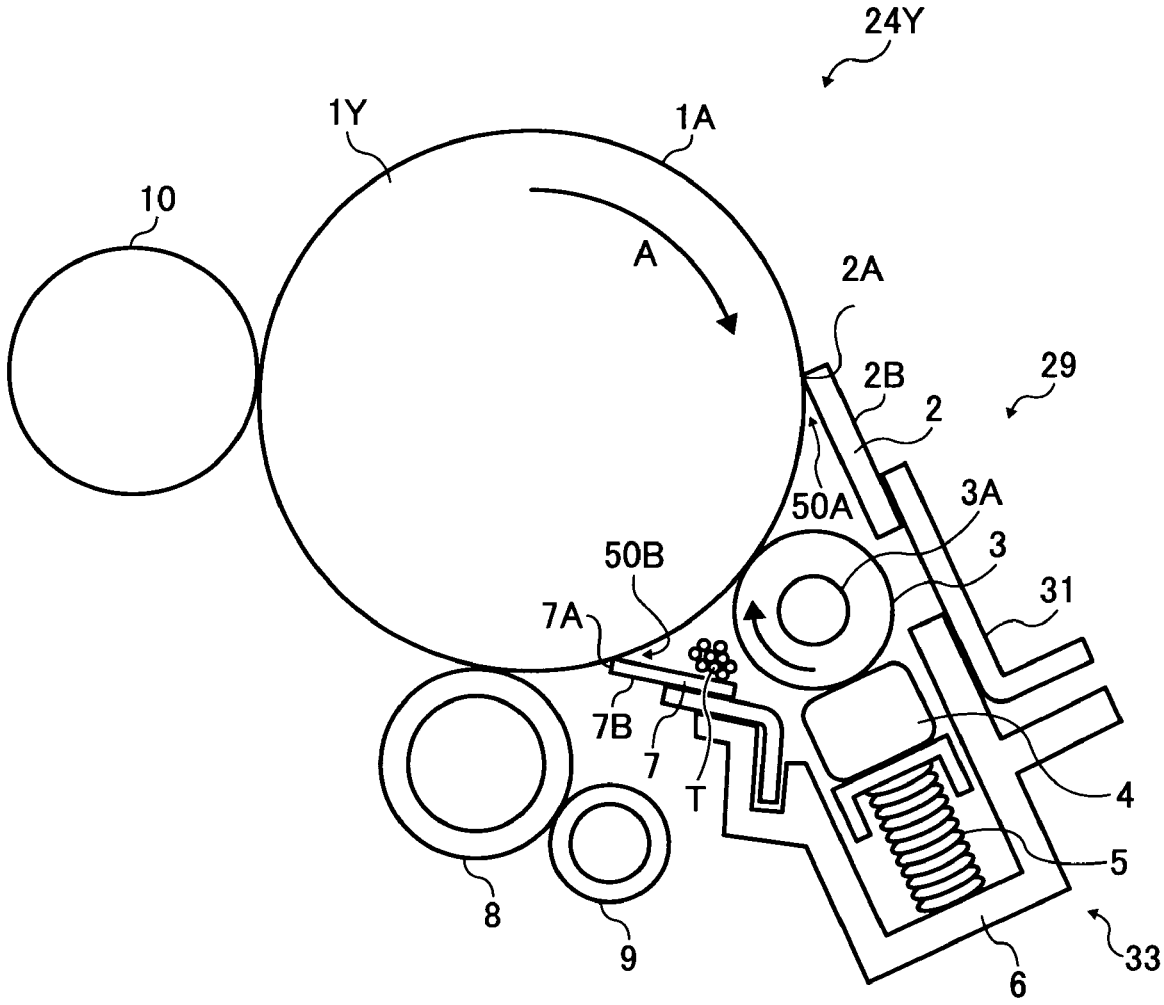
FIG. 3 is a sectional side view of the process cartridge shown in FIG. 2 along line A'-A'.
Figure 4:
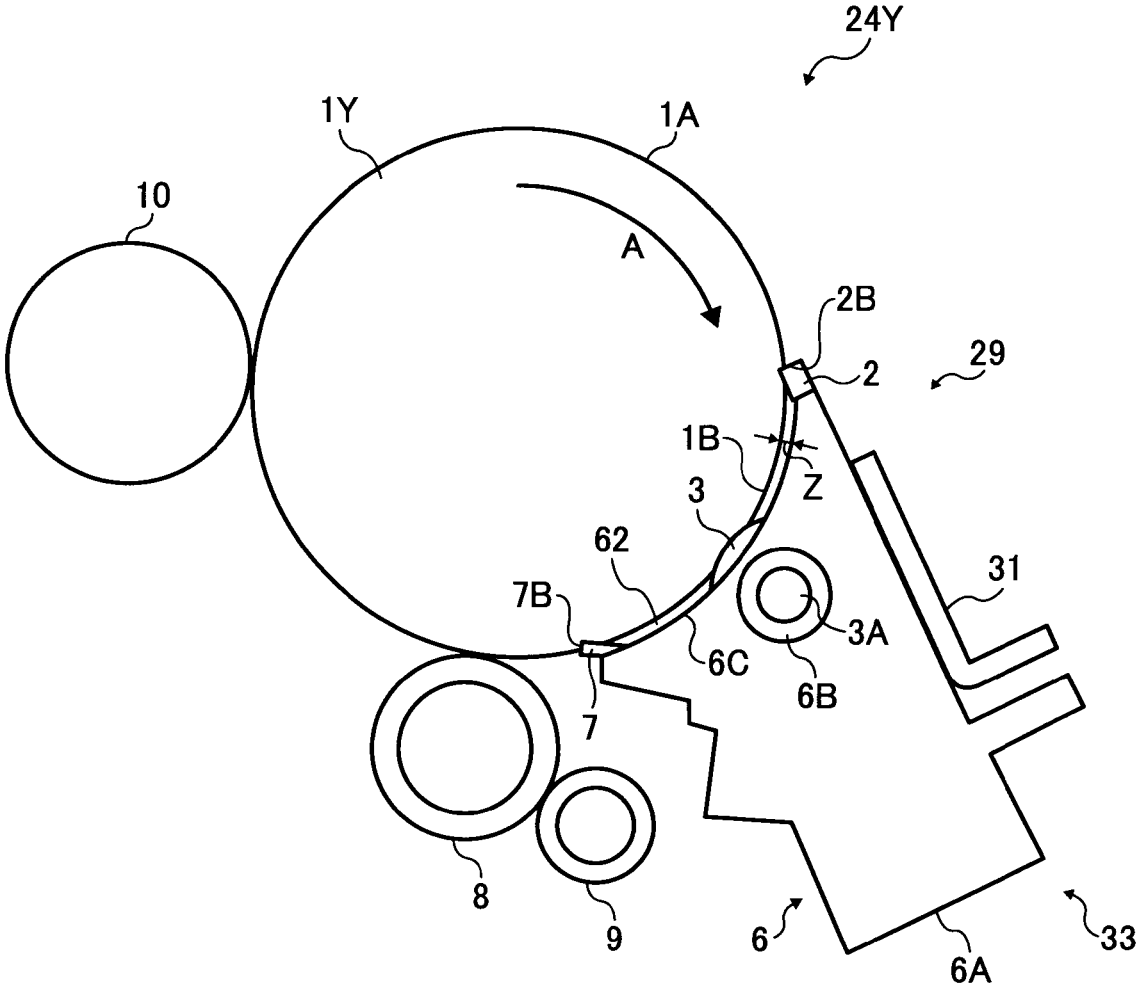
FIG. 4 is a side view of the process cartridge shown in FIG. 3.

Referring to FIGS. 2, 3, and 4, the following describes the cleaning blade 2, the lubricant application device 33, and the lubricant applicator blade 7. FIG. 2 is a partial cutaway top view of the process cartridge 24Y. FIG. 3 is a sectional side view of the process cartridge 24Y taken along line A'-A' shown in FIG. 2. FIG. 4 is a side view of the process cartridge 24Y shown in FIG. 2.

As illustrated in FIG. 2, the lubricant application device 33 further includes springs 5 and a frame 6. The photoconductor 1Y includes a surface 1A. The surface 1A includes side edges 1B. The cleaning blade 2 includes a top edge 2A and side edges 2B. The rotating brush 3 includes a rotation axis 3A.

As illustrated in FIG. 3, the process cartridge 24Y further includes spaces 50A and 50B. The lubricant applicator blade 7 includes a top edge 7A and side edges 7B.

As illustrated in FIG. 4, the lubricant application device 33 further includes a gap 62. The frame 6 includes side plates 6A. The side plate 6A includes a bearing 6B and a top edge 6C.

As illustrated in FIG. 2, the top edge 2A of the cleaning blade 2 contacts almost an entire width of the surface 1A of the photoconductor 1Y in a width or axial direction E (e.g., a direction of a rotation axis) of the photoconductor 1Y, so as to seal the space 50A (depicted in FIG. 3) formed between the photoconductor 1Y and the lubricant application device 33. The top edge 2A of the cleaning blade 2 slides on the surface 1A of the photoconductor 1Y to remove the residual toner adhered on the surface 1A of the photoconductor 1Y. The toner conveyance screw 32 (depicted in FIG. 1) discharges the removed toner outside the cleaning case 30 (depicted in FIG. 1).

As illustrated in FIG. 3, after the cleaning blade 2 cleans the surface 1A of the photoconductor 1Y, the spring 5 presses the solid lubricant 4 against the rotating brush 3, serving as a lubricant supplier. The solid lubricant 4 is scraped by rotation of the rotating brush 3 and unevenly adhered to the surface 1A of the photoconductor 1Y. In order to evenly spread the lubricant on the surface 1A of the photoconductor 1Y, the lubricant applicator blade 7 including a rubber portion is provided downstream from the rotating brush 3 in the direction of rotation A of the photoconductor 1Y. The lubricant applicator blade 7 spreads the lubricant supplied by the rotating brush 3 over the surface 1A of the photoconductor 1Y to form a lubricant layer with a uniform thickness on the surface 1A of the photoconductor 1Y.

Like the cleaning blade 2, the top edge 7A of the lubricant applicator blade 7 contacts almost the entire width of the surface 1A of the photoconductor 1Y, so as to seal the space 50B formed between the photoconductor 1Y and the lubricant application device 33. Accordingly, the spaces 50A and 50B formed between the photoconductor 1Y and the lubricant application device 33 in the direction of rotation A of the photoconductor 1Y are sealed. Due to damage and the like of the top edge 2A of the cleaning blade 2, a foreign object T including some residual toner slipping along the cleaning blade 2 and a powder of the solid lubricant 4 scraped by the rotating brush 3 remains between the brush roller 3 and the lubricant applicator blade 7.

The rotating brush 3 and the solid lubricant 4 are stored in the frame 6. As illustrated in FIG. 4, the side plates 6A cover both sides of the frame 6. The rotation axis 3A of the rotating brush 3 is rotatably supported by the bearings 6B provided on the side plates 6A. The top edge 6C of the side plate 6A extends from the top edge 2B of the cleaning blade 2 to the top edge 7B of the lubricant applicator blade 7 so as to close a space therebetween. The gap 62 is formed between the side edge 1B of the surface 1A of the photoconductor 1Y and the top edge 6C of the side plate 6A. Therefore, the foreign object T including small amounts of powder remaining between the cleaning blade 2 and the lubricant applicator blade 7 may be prevented from scattering in an axial direction of the photoconductor 1Y (e.g., the direction E depicted in FIG. 2) due to air flow or the like caused by rotation of the photoconductor 1Y, thereby preventing the scattered foreign object T from adhering to the inside and outside of the body 25 of the image forming apparatus 100 (depicted in FIG. 1).

Further, the gap 62 between the side edge 1B of the surface 1A of the photoconductor 1Y and the top edge 6C of the side plate 6A may prevent the top edge 6C of the side plate 6A from sliding on the surface 1A of the photoconductor 1Y, thereby preventing damage to the surface 1A of the photoconductor 1Y. Since the gap 62 has a width Z of about 1.5 mm, the foreign object T may be prevented from scattering from the lubricant application device 33 to the inside and outside of the image forming apparatus 100, thereby preventing the scattered foreign object T from adhering to components touched by a user and other functional components, as well as preventing a faulty image. The narrower the width Z of the gap 62 is, the more efficiently the foreign object T may be prevented from scattering. However, in actuality, taking into consideration the dimensional accuracy of manufactured components, precision of assembly, and the like, when the gap 62 has a width Z of about 2.5 mm or smaller, the foreign object T may be prevented from scattering.

According to the above-described exemplary embodiment, the rotating brush 3, serving as a lubricant supplier, includes a polyester conductive brush. The polyester conductive brush is preferable since the bristles remain substantially erect so as to stably supply the solid lubricant 4 (depicted in FIG. 3) for a long time period. The rotating brush 3 includes an original yarn with a thickness of about 280 T/24 F, a density of about 100 thousand bristles/sq. in., a total length of about 3 mm, and a length of a bristle contacting the photoconductor 1Y of about 1 mm, all figures obtained by experimentation under preferred conditions of application of the solid lubricant 4.

The solid lubricant 4 includes zinc stearate. As illustrated in FIG. 3, the spring 5 presses the solid lubricant 4 against the brush roller 3. The solid lubricant 4 is formed into a block having a density gradually varied. For example, a density of a part of the solid lubricant 4 contacting the rotating brush 3 is set to about 0.8 g/cm$^3$ in an early stage of usage, which is measured by an air comparison type densitometer in a temperature of about 25 degrees centigrade, and a density thereof after printing on 80 thousand sheets is set to about 1.1 g/cm$^3$. It is experimentally confirmed that a friction coefficient μ of the photoconductor 1Y remains at about 0.1 when a part of the solid lubricant 4 having a low density contacts the rotating brush 3 and when a part of the solid lubricant 4 having a high density contacts the rotating brush 3 over time with a decreased pressing force against the rotating brush 3. The solid lubricant 4 has a section size of about 10 mm by about 10 mm, and after printing on 80 thousand sheets, the solid lubricant 4 decreases by about 8 mm. Therefore, the solid lubricant 4 after printing on 80 thousand sheets is set to have a density of about 1.1 g/cm$^3$.

Further, according to the above-described exemplary embodiment, since the lubricant applicator blade 7 includes rubber, the solid lubricant 4 may be applied to the surface 1A of the photoconductor 1Y at a uniform pressure in the width direction E of the surface 1A of the photoconductor 1Y, thereby more stably applying the solid lubricant 4.

According to the above-described exemplary embodiment, as illustrated in FIGS. 3 and 4, since the lubricant application device 33 includes the side plates 6A, serving as a sealing member provided between the cleaning blade 2 and the lubricant applicator blade 7 and covering both ends of the rotating brush 3, serving as a lubricant supplier, the foreign object T may be prevented from scattering from both ends (e.g., the side edges 1B depicted in FIG. 2) of the photoconductor 1Y in the direction E and adhering to the inside and outside of the image forming apparatus 100.

Further, although according to the above-described non-limiting exemplary embodiment the photoconductor 1Y serving as an image carrier has a drum-like shape, alternatively the photoconductor 1Y may have an endless belt-like shape. Namely, the image carrier according to the above-described embodiment indicates a rotating image carrier having no end like a drum or an endless belt.

In addition, although the image forming apparatus 100 according to the above-described non-limiting exemplary embodiment forms a full-color image, alternatively the exemplary embodiment may be also applied to the image forming apparatus 100 forming a monochrome image.

According to the above-described non-limiting exemplary embodiment, the lubricant application device 33 applies a lubricant (e.g., the solid lubricant 4) to the photoconductor 1Y. However, the lubricant application device 33 may apply a lubricant to other device such as an intermediate transfer belt (e.g., the intermediate transfer belt 23 depicted in FIG. 1) or the like.

Figure 5:
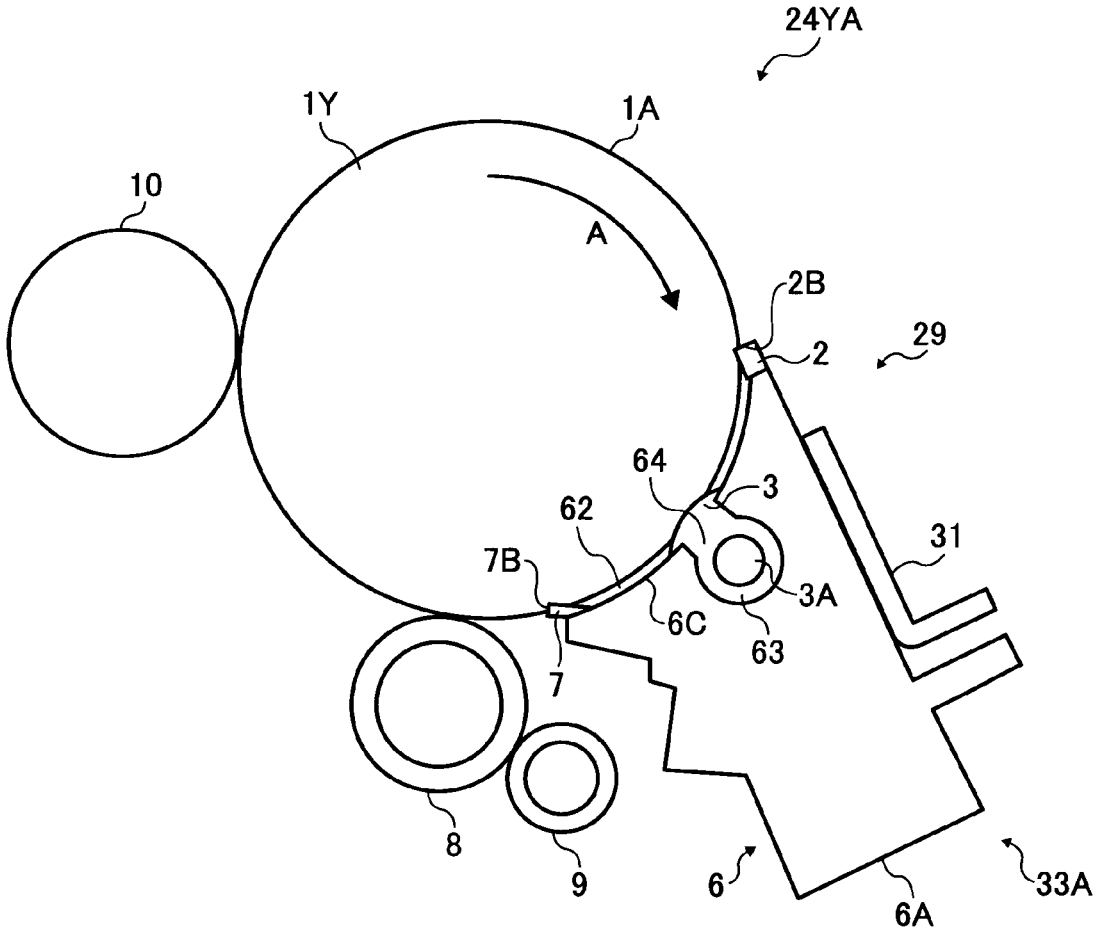
FIG. 5 is a side view of a process cartridge according to another exemplary embodiment of the present invention.

Referring to FIG. 5, the following describes a process cartridge 24YA according to another exemplary embodiment. FIG. 5 is a side view of the process cartridge 24YA. The process cartridge 24YA includes a lubricant application device 33A. The lubricant application device 33A includes gaps 63 and 64. The other elements of the process cartridge 24YA are common to the process cartridge 24Y depicted in FIG. 4.

In addition to the circular gap 62 provided between the top edge 6C of the side plate 6A and the surface 1A of the photoconductor 1Y in the lubricant application device 33 shown in FIG. 4, two more gaps 63 and 64 are provided as illustrated in FIG. 5. The gap 63 surrounds the rotation axis 3A of the rotating brush 3. The gap 64 is slightly wider than a diameter of the rotation axis 3A and connected to both the gap 62 and the gap 63. By forming the gaps 63 and 64 in the side plate 6A, the side plate 6A may be pulled down and detached from the lubricant application device 33A without detaching the rotating brush 3, thus facilitating removal of the foreign object T remaining between the cleaning blade 2 and the lubricant applicator blade 7.

In particular, when the photoconductor 1Y, the cleaning blade 2, and the lubricant application device 33A are integrated into the process cartridge 24YA, the photoconductor 1Y and the rotating brush 3 are fixed in a predetermined position by another side plate. Therefore, since the relative positions of the photoconductor 1Y and the rotating brush 3 are determined once and maintained thereafter, provision of the gaps 63 and 64 in the side plate 6A allows easy removal of the foreign object T remaining between the cleaning blade 2 and the lubricant applicator blade 7 by simply detaching the side plate 6A.

Figure 6:
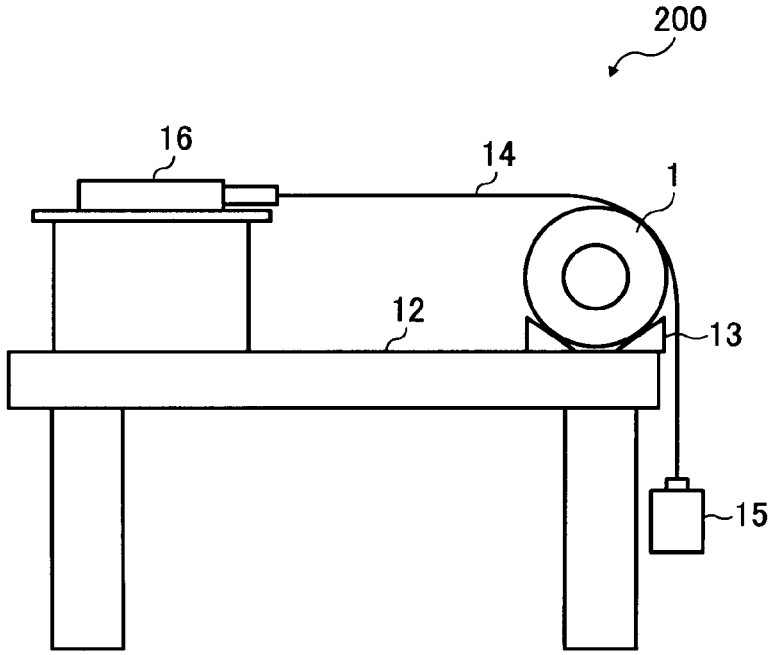
FIG. 6 illustrates a measurement device for measuring a surface friction coefficient of a photoconductor.
Figure 7:
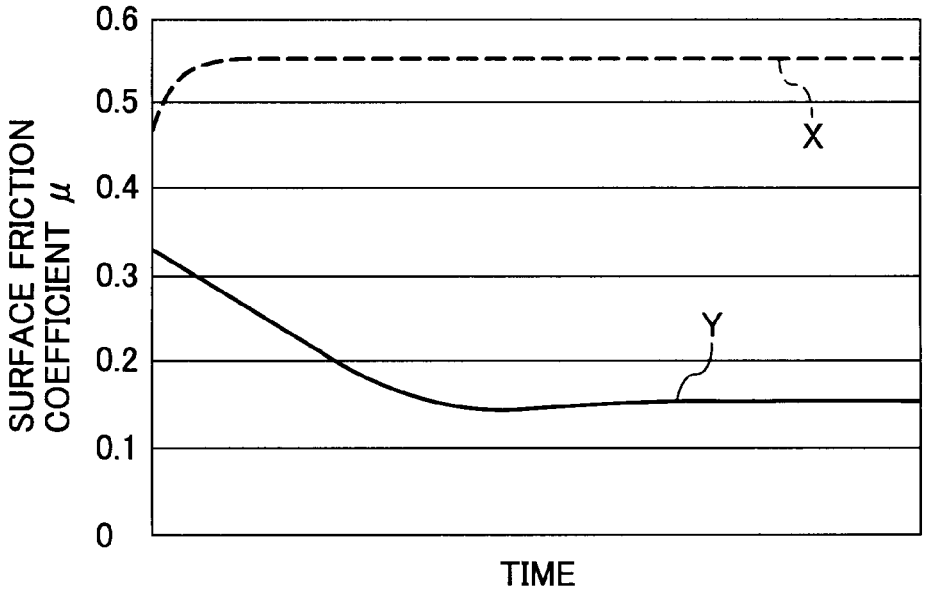
FIG. 7 is a graph illustrating changes over time of the surface friction coefficient of the photoconductor shown in FIG. 6.

Referring to FIGS. 6 and 7, a description is now given of a surface friction coefficient μ of a photoconductor. FIG. 6 illustrates a measurement device 200 for measuring the surface friction coefficient μ of the photoconductor.

The measurement device 200 includes a photoconductor 1, a test bench 12, a supporter 13, a belt 14, a weight 15, and a digital force gauge 16.

The measurement device 200 measures the surface friction coefficient μ of the photoconductor 1 using Euler's belt method. The photoconductor 1 has a drum-like shape and is fixed on the supporter 13 placed on the test bench 12. The belt 14 is hung over a surface of the photoconductor 1. Hooks, not shown, are attached to both ends of the belt 14. One end is connected to the digital force gauge 16, and the other is hung with the weight 15 (e.g., a 100-gram weight). A position of the digital force gauge 16 is adjusted by pulling the digital force gauge 16 in a direction perpendicular to a direction in which the weight 15 is hung. The digital force gauge 16 indicates a value F when the belt 14 starts to move. Substitution of the value F in the following formula (1) yields a surface friction coefficient μ of the photoconductor 1. The belt 14 includes a slip of high-quality paper of medium thickness (e.g., long grain #6200 paper of about 30 mm by about 250 mm).

$$\mu = \ln(F/W)/(\pi/2) \quad (1)$$

In the above formula (1), μ represents a surface friction coefficient. F represents a value indicated by the digital force gauge 16. W represents a weight.

Generally, a surface friction coefficient μ of the photoconductor 1 with no lubricant applied and when not yet in use is from about 0.5 to about 0.6. After performing an electrophotographic image forming process, the surface friction coefficient μ increases to from about 0.6 to about 0.7, and sliding pressure of the cleaning blade 2 (depicted in FIG. 3) increases, so that noise of the cleaning blade 2 and wear of the photoconductor 1 may increase. Conversely, the surface friction coefficient μ of the photoconductor 1 applied with lubricant decreases to about 0.1 or smaller, thereby improving wear resistance and cleaning property. However, if excessive lubricant is adhered to the photoconductor 1, the lubricant slips too much, causing slipping of a developer or a toner. As a result, edges of a printed character appear unclear. Although resolution seems to have been increased, the image may not be sharply distinguished from the background and a halftone image lacks uniformity and becomes blurred. Therefore, excessive decrease of a surface friction coefficient μ of the photoconductor 1 is undesirable. Thus, the surface friction coefficient μ is preferably about 0.4 or smaller, and more preferably in a range of from about 0.1 to about 0.3. However, when the surface friction coefficient μ is 0.1 or smaller, image quality may deteriorate. Accordingly, if a preferred amount of the lubricant is supplied to the photoconductor 1, the surface friction coefficient μ of the photoconductor 1 may be maintained in the preferred range of from about 0.1 to about 0.3.

FIG. 7 is a graph illustrating changes over time of the surface friction coefficient μ of the photoconductor 1 when a lubricant is applied to the surface of the photoconductor 1 and when no lubricant is applied thereto.

In FIG. 7, a curved line X shows measurement results when no lubricant is applied and a curved line Y shows measurements result when a lubricant is applied. As is clear therefrom, when no lubricant is applied, the curved line X shows that the surface friction coefficient μ of the photoconductor 1 sharply increases at an early stage of using the photoconductor 1 in the image forming apparatus 100, and then gradually increases over time as the photoconductor 1 is used. On the other hand, when a lubricant is applied, the curved line Y shows that the surface friction coefficient μ is low at the early stage of using the photoconductor 1, decreases over time as the photoconductor 1 is used, and remains at about 0.15 after a predetermined usage time passes. Therefore, application of the lubricant to the surface of the photoconductor 1Y may stably maintain a low surface friction coefficient μ of the surface of the photoconductor 1 as long as the application continues.

Any type of commercially available lubricant, including a liquid lubricant, a semisolid lubricant, and a solid lubricant, may be used. However, considering its convenience in handling, the solid lubricant is preferable. A powdery lubricant included in the solid lubricant is difficult to handle because it tends to scatter in the image forming apparatus 100. Therefore, the solid lubricant including a solidified powdery lubricant is easy to handle and transfer to the photoconductor 1Y (depicted in FIG. 1) serving as an image carrier, causing no faulty image.

The solid lubricant includes fatty acid metallic salts such as lead oleate, zinc oleate, copper oleate, zinc stearate, cobalt stearate, iron stearate, copper stearate, zinc palmitate, copper palmitate, and zinc linolenate, talc, fluorocarbon resins such as polytetrafluoroethylene, polychlorotrifluoroethylene, polyvinylidene-fluoride, polytrifluorochlorethylene, dichlorodifluoroethylene, tetrafluoroethylene-ethylene copolymer, and tetrafluoroethylene-oxafluoropropylene copolymer, and natural wax such as carnauba wax.

As a way of decreasing wear of the thin film photoconductor 1Y (e.g., an organic photoconductor) serving as an image carrier and scraping of a film of the surface of the photoconductor 1Y due to friction between the photoconductor 1Y and components around the photoconductor 1Y, the present invention decreases a surface friction coefficient μ of the thin film photoconductor 1Y.

More specifically, as illustrated in FIG. 1, in an electrophotographic image forming process, many components contact the photoconductor 1Y and scrape the surface of the photoconductor 1Y. Among them, the cleaning blade 2 largely scrapes the surface of the photoconductor 1Y.

Conventionally, a lifetime of the photoconductor 1Y is determined by a degree of wear of the photoconductor 1Y. This is because when wear of an exposure layer of the photoconductor 1Y reaches a predetermined amount, electrical characteristics of the photoconductor 1Y change so that a predetermined image forming process may not be executed. If the exposure layer of the photoconductor 1Y is worn due to contact with components other than the cleaning blade 2 in the image forming process, the lifetime of the photoconductor 1Y may not be affected. However, when the cleaner 29 including the cleaning blade 2 slidably contacts the photoconductor 1Y, since the cleaning blade 2 mechanically removes toner particles remaining on the photoconductor 1Y, the lifetime of the photoconductor 1Y may be shortened.

There are two types of wear of the photoconductor 1Y due to the cleaning blade 2. One is caused by shear force of the photoconductor 1Y and the cleaning blade 2, and the other is caused by toner particles moving like grindstones when the toner particles are sandwiched between the cleaning blade 2 and the photoconductor 1Y. Factors determining extent of the above-described wear include structural strength of the photoconductor 1Y, contact pressure of the cleaning blade 2, composition of the toner particles, and surface friction coefficient μ of the photoconductor 1Y.

In the present invention, a configuration that decreases the surface friction coefficient μ of the photoconductor 1Y for efficiently applying a lubricant and preventing a foreign substance from scattering is adopted, as described below.

Specifically, application of a lubricant for maintenance of surface characteristics of the photoconductor 1Y and various types of stabilizers for protection of characteristics of the photoconductor 1Y may prevent wear of the exposure layer and degradation of the characteristics of the photoconductor 1Y, thereby obtaining a durable image forming apparatus 100.

For example, application of a lubricant to the photoconductor 1Y may decrease friction between the photoconductor 1Y and the cleaning blade 2. In order to decrease the friction, a lubricant supplier (e.g., the rotating brush 3) is provided in the exemplary embodiment of the present invention. Application of a lubricant to the photoconductor 1Y by the rotating brush 3 may decrease the surface friction coefficient μ of the photoconductor 1Y, and prevent adhesion of excessive toner particles to the photoconductor 1Y, thereby providing an image without background soiling. Further, by application of a lubricant by the rotating brush 3 and removal of a residual toner by the cleaning blade 2, a clean surface of the photoconductor 1Y may be maintained, thereby extending the lifetimes of the photoconductor 1Y and the image forming apparatus 100, and reducing costs. Moreover, since an amount of toner adhering to non-image regions in the image forming apparatus 100 may be reduced, thereby achieving efficient utilization of toner and saving resources.

However, as illustrated in FIG. 3, as seen in section in the direction of rotation A of the photoconductor 1Y, the minute foreign object T including adhesions such as toner particles remaining on the photoconductor 1Y after slipping on the cleaning blade 2 and powder from the solid lubricant 4 failing to be applied to the photoconductor 1Y accumulates over time in the space between the surface 1A of the photoconductor 1Y, the cleaning blade 2, and the lubricant applicator blade 7.

Moreover, generally, air flows around the photoconductor 1Y in order to discharge heat radiation, charged products, ozone, and the like. Even though the cleaning blade 2 and the lubricant applicator blade 7 seal the spaces between the surface 1A of the photoconductor 1Y and the cleaning blade 2, and between the surface 1A of the photoconductor 1Y and the lubricant applicator blade 7, if there is a large opening at both ends of the photoconductor 1Y between the cleaning blade 2 and the lubricant applicator blade 7 in the axial direction of the photoconductor 1Y, the minute foreign object T may be scattered from the opening by the air flowing in from both ends of the photoconductor 1Y and may adhere to the outside of the image forming apparatus 100 or components provided inside the image forming apparatus 100 and touched by a user. Alternatively, when the foreign object T adheres to other functional components in the image forming apparatus 100, a faulty image including banding may be formed or toner adhering to the functional components may fall onto a recording medium and form a faulty image.

Therefore, according to the exemplary embodiments of the present invention, as illustrated in FIG. 4, in order to prevent the foreign object T from scattering from both ends of the photoconductor 1Y in the axial direction of the photoconductor 1Y, a sealing member (e.g., the side plate 6A) is provided between the cleaning blade 2 and the lubricant applicator blade 7, so that the space between the cleaning blade 2 and the lubricant applicator blade 7 at both ends of the rotating brush 3 may be sealed.

When the side plate 6A includes a sponge and a felt, the side plate 6A may contact and slide on the surface 1A of the photoconductor 1Y to seal the rotating brush 3. However, the surface 1A of the photoconductor 1Y may be damaged due to contact between the side plate 6A and the surface 1A of the photoconductor 1Y. Further, scraping of the surface 1A of the photoconductor 1Y may generate a foreign object and an increase in drive torque of the photoconductor 1Y. Contact between the side plate 6A and the surface 1A of the photoconductor 1Y may raise temperature of the surface 1A of the photoconductor 1Y, which in turn may cause fixation of toner or the like. Therefore, according to the above-described exemplary embodiment, provision of the minute gap 62 between the side edge 1B of the photoconductor 1Y and the top edge 6C of the side plate 6A may prevent scraping of the photoconductor 1Y while preventing the foreign object T from scattering, thereby preventing damage of the photoconductor 1Y.

As can be appreciated by those skilled in the art, although the present invention has been described above with reference to specific exemplary embodiments the present invention is not limited to the specific embodiments described above, and various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A lubricant application device, comprising:

a lubricant supplied to a surface of an image carrier for carrying a toner image;

a lubricant supplier provided downstream from a cleaning blade for removing residual toner after the toner image is transferred from the image carrier in a direction of movement of the image carrier and configured to supply the lubricant to the surface of the image carrier;

a lubricant smoother provided downstream from the lubricant supplier in the direction of movement of the image carrier and configured to slidably contact the image carrier to smooth the lubricant supplied to the surface of the image carrier; and a sealing member configured to seal a space between the cleaning blade and the lubricant smoother at both ends of the lubricant supplier in an axial direction of the image carrier, while the cleaning blade and the lubricant smoother seal spaces between the surface of the image carrier and the cleaning blade and between the surface of the image carrier and the lubricant smoother in an axial direction of the image carrier, wherein a gap is provided between a side edge of the surface of the image carrier and a top edge of the sealing member in a direction perpendicular to an axial direction of the image carrier, extending in the longitudinal direction of the image carrier.

2. The lubricant application device according to claim 1, wherein the lubricant supplier includes a rotating brush and the sealing member includes a side plate configured to support the rotating brush.

3. The lubricant application device according to claim 2, wherein the lubricant includes a solid lubricant pressed against the rotating brush, scraped by rotation of the rotating brush, and adhered to the surface of the image carrier.

4. The lubricant application device according to claim 2, further including:

a second gap provided in the sealing member, surrounding a rotation axis of the rotating brush; and a third gap provided in the sealing member connecting a first gap to the second gap, wherein the third gap is wider than a diameter of the rotation axis.

5. The lubricant application device according to claim 1, wherein the lubricant smoother includes a rubber blade configured to slidably contact the surface of the image carrier.

6. A process cartridge attachable to and detachable from an image forming apparatus, the process cartridge comprising:

an image carrier configured to carry a toner image;

a cleaning blade configured to remove residual toner after the toner image is transferred from the image carrier; and a lubricant application device, including:

a lubricant supplied to a surface of the image carrier;

a lubricant supplier provided downstream from the cleaning blade in a direction of movement of the image carrier and configured to supply the lubricant to the surface of the image carrier;

a lubricant smoother provided downstream from the lubricant supplier in the direction of movement of the image carrier and configured to slidably contact the image carrier to smooth the lubricant supplied to the surface of the image carrier; and a sealing member configured to seal a space between the cleaning blade and the lubricant smoother at both ends of the lubricant supplier in an axial direction of the image carrier, while the cleaning blade and the lubricant smoother seal spaces between the surface of the image carrier and the cleaning blade and between the surface of the image carrier and the lubricant smoother in an axial direction of the image carrier, wherein a gap is provided between a side edge of the surface of the image carrier and a top edge of the sealing member in a direction perpendicular to an axial direction of the image carrier, extending in the longitudinal direction of the image carrier.

7. An image forming apparatus, comprising:

an image carrier configured to carry a toner image;

a cleaning blade configured to remove residual toner after the toner image is transferred from the image carrier; and a lubricant application device, including:

a lubricant supplied to a surface of the image carrier;

a lubricant supplier provided downstream from the cleaning blade in a direction of movement of the image carrier and configured to supply the lubricant to the surface of the image carrier;

a lubricant smoother provided downstream from the lubricant supplier in the direction of movement of the image carrier and configured to slidably contact the image carrier to smooth the lubricant supplied to the surface of the image carrier; and a sealing member configured to seal a space between the cleaning blade and the lubricant smoother at both ends of the lubricant supplier in an axial direction of the image carrier, while the cleaning blade and the lubricant smoother seal spaces between the surface of the image carrier and the cleaning blade and between the surface of the image carrier and the lubricant smoother in an axial direction of the image carrier, wherein a gap is provided between a side edge of the surface of the image carrier and a top edge of the sealing member in a direction perpendicular to an axial direction of the image carrier, extending in the longitudinal direction of the image carrier.

8. The image forming apparatus according to claim 7, wherein the image carrier, the cleaning blade, and the lubricant application device are integrated into a process cartridge attachable to and detachable from the image forming apparatus.

* * * * *